US008403131B2

(12) United States Patent
Rovelli

(10) Patent No.: US 8,403,131 B2
(45) Date of Patent: Mar. 26, 2013

(54) RESERVOIR CAP

(75) Inventor: Ivan Rovelli, Monza (IT)

(73) Assignee: Capsol S.p.A., Bulciago (LC) (IT)

( * ) Notice: Subject to any disclaimer, the term of this patent is extended or adjusted under 35 U.S.C. 154(b) by 57 days.

(21) Appl. No.: 12/850,946

(22) Filed: Aug. 5, 2010

(65) Prior Publication Data

US 2011/0266171 A1 Nov. 3, 2011

(30) Foreign Application Priority Data

Apr. 30, 2010 (IT) ..... MI2010A0758

(51) Int. Cl.
*B65D 25/08* (2006.01)

(52) U.S. Cl. ..... 206/222; 220/521

(58) Field of Classification Search ..... 206/219, 206/217, 222, 568; 220/288, 255.1, 502, 220/212, 203.08, 521; 215/227, 228, 247, 215/250, 251, 252, 254, DIG. 8
See application file for complete search history.

(56) References Cited

U.S. PATENT DOCUMENTS

| | | | | |
|---|---|---|---|---|
| 4,058,232 | A | 11/1977 | Ohno et al. | |
| 4,757,916 | A * | 7/1988 | Goncalves | 222/83 |
| 4,781,484 | A | 11/1988 | Goncalves | |
| 4,962,852 | A * | 10/1990 | Affaitati et al. | 206/222 |
| 5,884,759 | A * | 3/1999 | Gueret | 206/222 |
| 6,073,803 | A * | 6/2000 | Sturm et al. | 222/80 |
| 6,763,939 | B2 * | 7/2004 | Alticosalian | 206/222 |
| 7,546,919 | B2 * | 6/2009 | Lee | 206/221 |
| 7,748,550 | B2 * | 7/2010 | Cho | 215/228 |
| 2005/0161348 | A1 * | 7/2005 | Morini | 206/219 |
| 2007/0289663 | A1 * | 12/2007 | Johns et al. | 141/112 |
| 2008/0035497 | A1 * | 2/2008 | Im | 206/219 |
| 2008/0093326 | A1 * | 4/2008 | Cho | 215/228 |
| 2008/0171109 | A1 | 7/2008 | Hsieh | |
| 2008/0290061 | A1 | 11/2008 | Seelhofer | |
| 2009/0139882 | A1 * | 6/2009 | DeJonge | 206/219 |
| 2010/0059394 | A1 * | 3/2010 | Fontana | 206/222 |
| 2010/0163442 | A1 | 7/2010 | Lee et al. | |

FOREIGN PATENT DOCUMENTS

| | | | |
|---|---|---|---|
| DE | 2709816 | | 9/1977 |
| EP | 0238371 | A1 | 9/1987 |
| IT | MI2006A000680 | A | 10/2007 |
| WO | 2006037244 | A1 | 4/2006 |
| WO | 2007069845 | A1 | 6/2007 |

* cited by examiner

*Primary Examiner* — Jacob K Ackun
*Assistant Examiner* — Jenine Pagan
(74) *Attorney, Agent, or Firm* — Novak Druce Connolly Bove + Quigg, LLP

(57) ABSTRACT

A reservoir cap to be positioned on a neck of a container at an aperture thereof, including a first element in which a chamber, closed by a pierceable wall, is provided to house a product introducible into the interior of the container, and a second element including a piercer for piercing the pierceable wall. The first and second element being axially movable relative to each other, such that the movement causes piercing of the pierceable wall, with consequent introduction of the product into the container. The first element includes a first connector for connection to the container, which cooperate with an external portion of the neck of the container, and second connector for connection to the second element. The second connector including a thread cooperating with at least one tooth engaged in it.

8 Claims, 3 Drawing Sheets

RESERVOIR CAP

CROSS REFERENCE TO RELATED APPLICATIONS

This application claims the priority of Italian Patent Application No. MI2010A000758 filed on Apr. 30, 2010.

The present invention relates to an improved reservoir cap in accordance with the introduction to the main claim.

In particular, it relates to a reservoir cap to be positioned on a container neck at an aperture thereof.

Known reservoir caps are commonly used when, for example in the medical field, an active principle, usually in powder form, has to be mixed with a liquid only a few moments prior to its use.

For example, such caps are widely used for products such as vitamins, live or antibiotic lactic cultures, which on contact with liquid deteriorate within a short time, whereas they can be preserved at length if isolated.

Known caps comprise a first element defining the reservoir. This element is simply inserted as an interference fit into the container aperture and presents a shoulder which abuts against a portion of the container neck to limit its insertion into the container. A second element is inserted into the first element, again as an interference fit, to act as a closure for the chamber while at the same time acting as the element for piercing the chamber base when pressed.

The unit is covered by a screw cover of conventional type which is screwed onto the container and protects both the first and the second element; when the screw cover is screwed down, it presses on the second element and urges it until it pierces the chamber base, hence causing the product to fall into the container.

A cap such as that described is known in Italian patent application IT MI2006A000680

These known caps present considerable drawbacks.

In particular it is difficult for weak persons to operate the chamber piercing mechanism, given that a certain pressure has to be applied to the piercing element.

An object of the present invention is to provide a reservoir cap which overcomes the technical drawbacks of the known art, and in particular to provide a cap which can be easily operated even by weak persons.

A further object of the present invention is to provide a reservoir cap which, prior to use, enables the reservoir contents to be totally isolated from the product vapours present in the container, hence lengthening the product preservation period.

These and other objects, which will be apparent to the expert of the art, are attained by a reservoir cap formed in accordance with the technical teachings of the accompanying claims.

Further characteristics and advantages of the invention will be apparent from the description of a preferred but non-exclusive embodiment of the reservoir cap, illustrated by way of non-limiting example in the accompanying drawings, in which.

Figure 1:
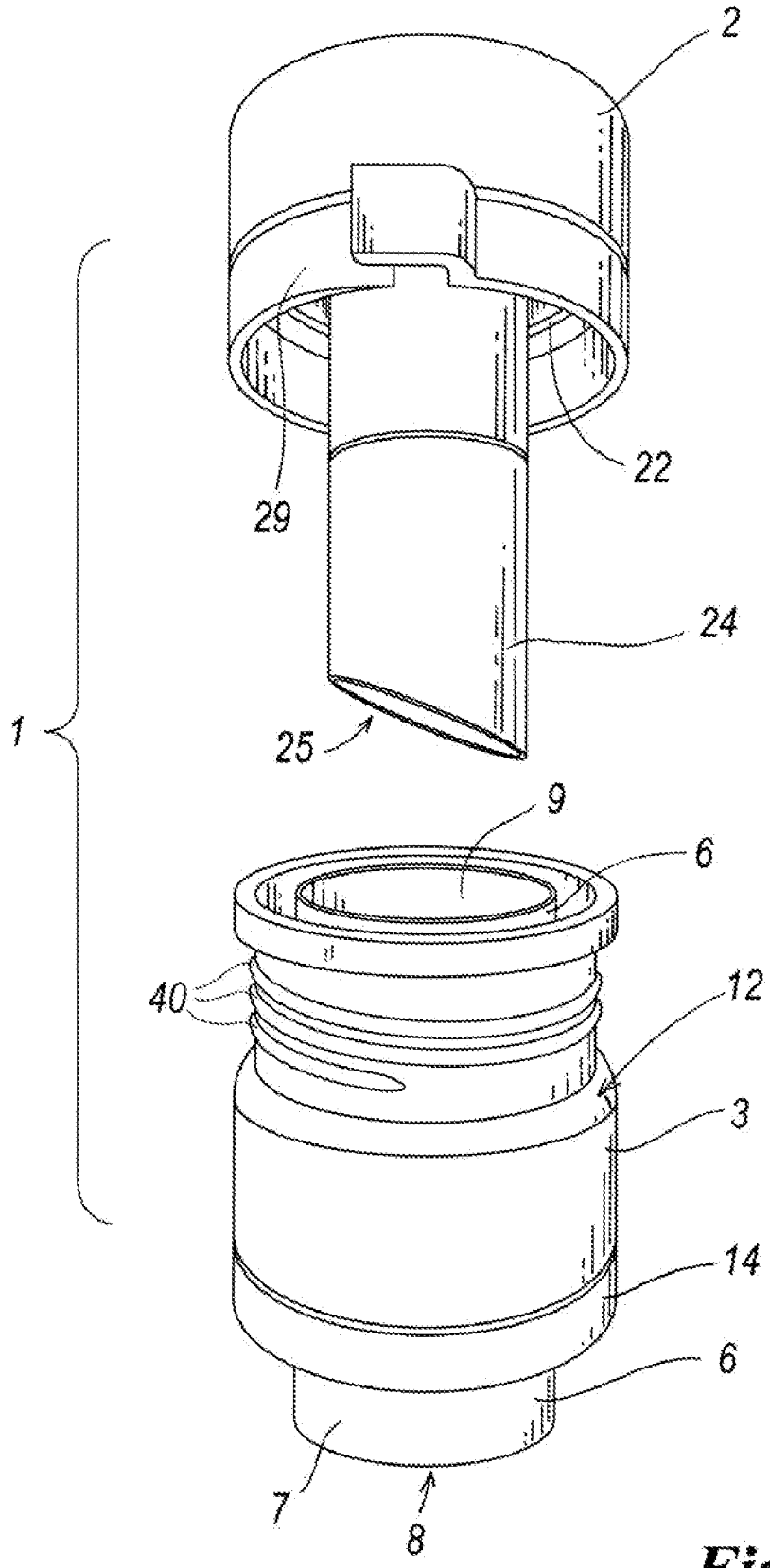
FIG. 1 is a perspective view of the two elements with which the reservoir cap of the present invention is formed.

With reference to said figures, these show a reservoir cap indicated overall by 1.

The cap is formed from a first element 3 to be secured to a container 4 at an aperture 5 thereof, and a second element 2 cooperating with said first element 3.

The first element 3 presents cylindrical symmetry and comprises an annular wall 6 closed at one end 7 by a pierceable wall 8.

The annular wall 6 and its base 8 define a chamber 9 to house, together with a cavity of the second element, a product 10 (preferably in powder form) insertable into the container 4. The annular wall 6 presents a first portion 6*a* having a first diameter less than the inner diameter of a neck 4*a* of the container 4, and a second portion 6*b* of outer diameter similar to the inner diameter of the container; the two portions are interconnected with continuity by an inclined interconnection portion 11.

From the central portion of the wall 6 a continuous flange 12 extends perpendicularly, from which there extends a threaded cylindrical wall 13 presenting lowerly a safety lip 14 connected by a plurality of breakable teeth 15. The lip presents a tooth 16 with a lead-in 16*a*. When the first element is screwed down on the container, the tooth 16 engages an abutment 18 on the container. Hence the first element can no longer be removed from the container without tearing off the teeth 16 of the lip.

From the flange 12 a first annular wall 19 extends to define, together with the wall portion 6 above the flange 12, a sealed annular housing 21 for a third annular wall projecting from the second element.

At its top, said wall presents limit stop means 23 which cooperate in undercut manner with the second element 2.

A thread 40, well visible in the figures, is provided on the external surface of the first wall 19.

The second element 2 comprises a cup-shaped piece 2*a* from which there centrally extends an internally hollow elongate cylindrical piercing means 24 presenting an end portion inclined as a cutter 25 which facilitates piercing of the wall 8. In particular the outer diameter of the piercing means coincides with the inner diameter of the first portion 6*a* of the wall 6. The cavity of the piercing means 24, together with a portion of the chamber 9, are adapted to house an active principle, preferably in powder form.

Said third annular wall 22 extends between the cup-shaped piece 2*a* and the piercing means.

Figure 2:
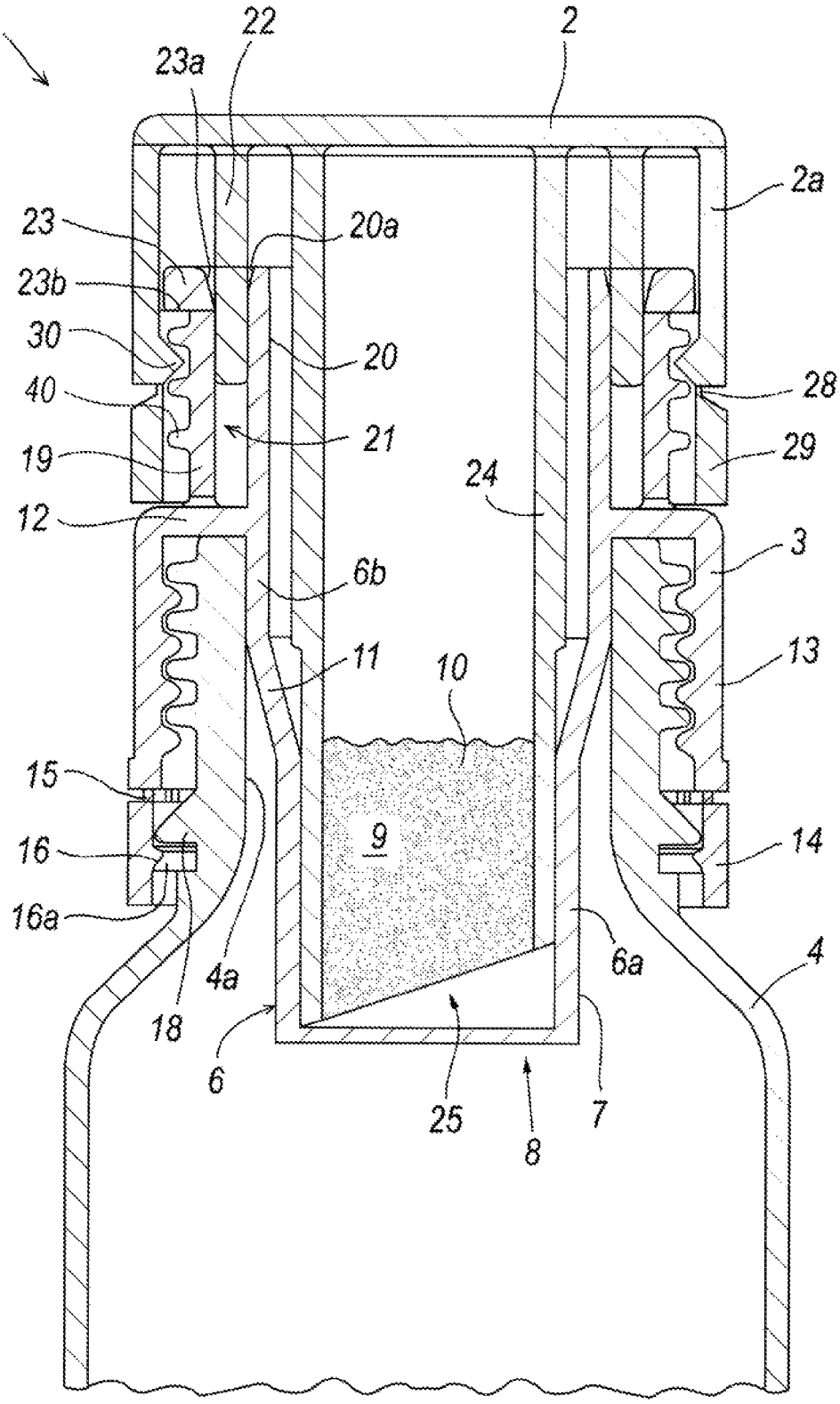
FIG. 2 is a lateral section through a cap of the present invention while being applied to a container and shown in its upper limit position.

From the cup-shaped piece 2*a*, and specifically from a fourth annular wall which defines the perimetral part thereof, a plurality of breakable teeth 28 project to fix a second safety lip 29. The fourth annular wall comprises an internal projection 30. A tooth 30 is provided on the fourth annular wall 2*a* to engage in the thread 30 when the second element is in its upper limit position (FIG. 2).

The invention operates in the following manner.

Initially the cavity of the piercing means 24 is filled with active principle in powder form, for example an antibiotic. The second element 2 is then placed on the first element 3 , inserting the piercing means 24 into the chamber 9. In this manner the powder remains trapped within the piercing means 24 and partially fills the chamber 9.

The second element 2 is pushed onto the first element 3 until the tooth 30 snaps over the limit stop 23, to hence engage in the thread 40.

During this coupling, the third annular wall 22 becomes sealedly inserted into the housing 21; advantageously the first wall 23 and the second wall 20 present lead-ins 23*a*, 20*a*, to facilitate centering of the third wall 22. Likewise the inclined wall 11 acts as a lead-in for the piercing means 24.

When the safety lip abuts against the flange 12, the piercing means 24 is slightly spaced from the base wall 8 of the chamber 9, as can be seen in FIG. 2.

Advantageously, under these conditions the active principle 9 is perfectly isolated from any vapours discharged by the contents of the container 4 and from the moisture present in the air surrounding the cap. In this respect, any vapours present in the container pass between the internal wall of the container and the external wall of the chamber 9, to run along the flange 12 and through the thread, to then disperse in the environment.

The externally present moisture is instead blocked by the "labyrinth" formed by the walls 20, 22 and 24 in addition to the interference present between the piercing means and the wall 6.

When in use, the second element 2 is made to rotate. The tooth 30, engaged by the thread, urges the second element 2 downwards to thus pierce the base 8 of the chamber 9, with consequent fall of the product into the container. In addition the lip 29, in contact with the flange 12, is torn off to indicate that the chamber has been pierced.

Figure 3:
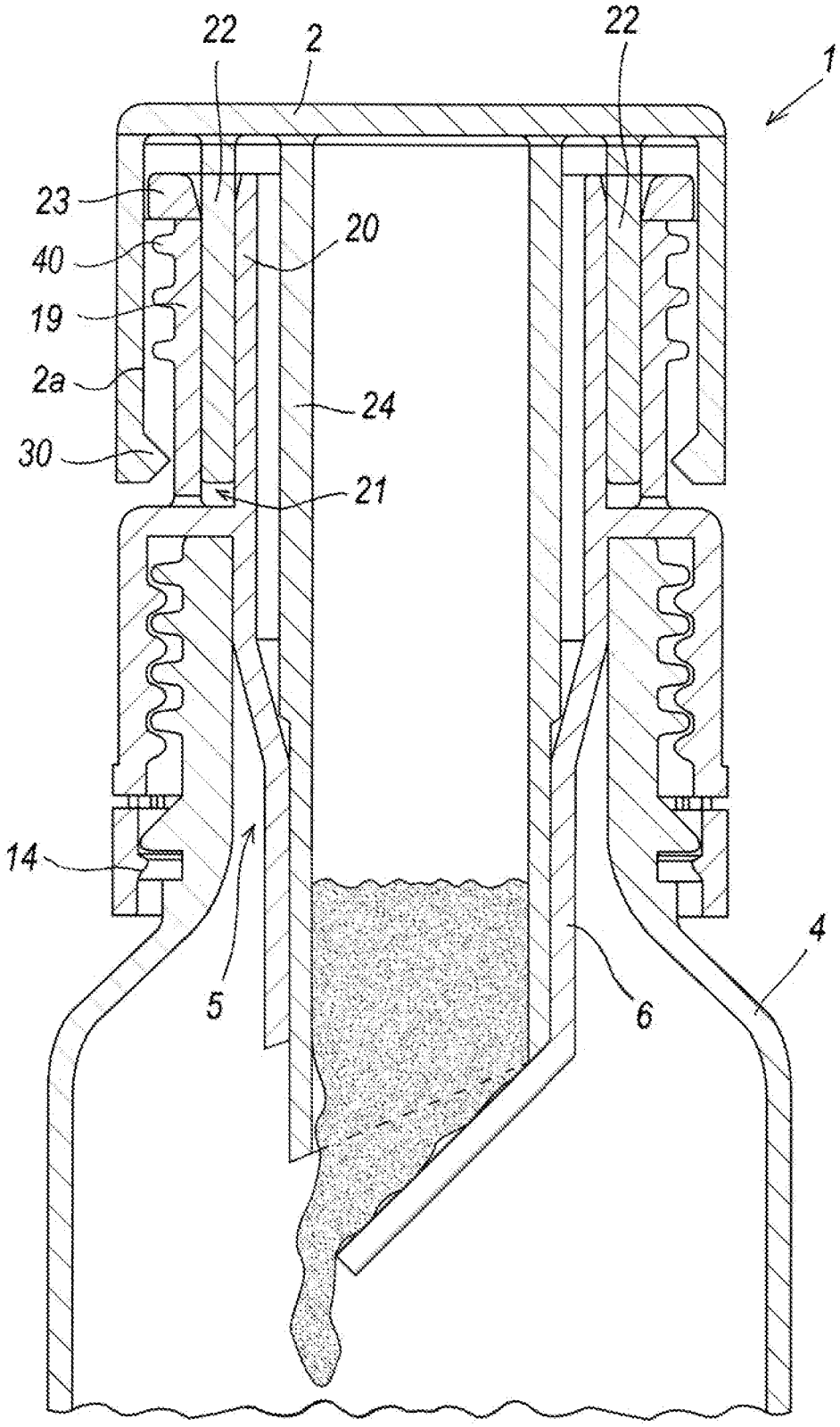
FIG. 3 is a lateral section through the present cap during its use, shown in its lower limit position.

As can be seen from FIG. 2 the thread 40 extends for a height such that, when the second element 2 is in its upper limit stop position, the tooth 30 is engaged in the thread, whereas when the second element 2 is in its lower limit stop position with the wall pierced (FIG. 3), the tooth 30 is disengaged from the thread. In this manner, counter-rotating the second element 2 does not cause the first element 3 and second element 2 to separate, as the second element 2 rotates idly in the limit stop position.

The container is then agitated to mix the powder with the liquid, and the first element 3 is unscrewed, hence making the container contents easily accessible.

A preferred embodiment of the invention has been illustrated, however others can be conceived utilizing the same inventive concept.

In particular, a sealed housing 21 could possibly not be provided, hence neither the annular wall 19 nor the annular wall 22 would be present. In this case the thread could be provided externally on the wall 20, in which case the wall 2*a* would be closer to the wall 20 to enable the tooth to cooperate with the thread.

Optionally, in all the described embodiments a suitable counter-thread could be provided in place of the tooth 30.

Various embodiments have been illustrated, however others can be conceived utilizing the same inventive concept.

The invention claimed is:

1. A reservoir cap to be positioned on a neck of a container at an aperture thereof, comprising a first element in which a chamber, closed by a pierceable wall, is provided to house a product introducible into the interior of the container, and a second element comprising means for piercing said pierceable wall, said first and second element being axially movable relative to each other, such that the movement causes piercing of the pierceable wall, with consequent introduction of said product into the container, said first element comprising first means for connection to said container, which cooperate with an external portion of said neck of the container, and second means for connection to said second element, said second means comprising a thread cooperating with at least one tooth engageable in said thread, wherein said first element comprises a first annular wall and a second annular wall which extend from a top of the first element to define a sealed housing for a corresponding third annular wall provided on said second element, and when the second element is fit on the first element, the third annular wall is sealedly inserted into the housing, wherein the thread is formed externally on said first annular wall and cooperates with a tooth projecting internally from a fourth cup-shaped portion of said second element.

2. A cap as claimed in claim 1, wherein said thread extends through a height such that, when the first element is in an upper limit stop position, the tooth is engaged in the thread, whereas when the first element is in a lower limit stop position, the tooth is disengaged from said thread, such that counter-rotating the first element does not cause separation of the first and second element.

3. A cap as claimed in claim 1, wherein said first connection means and said chamber are connected together by a flange which projects with continuity from an external surface of said chamber.

4. A cap as claimed in claim 1, wherein said first connection means are threaded and cooperate with a corresponding threaded portion of said neck.

5. A cap as claimed in claim 1, wherein said first means present a first safety lip adapted to engage with an abutment provided on said neck.

6. A cap as claimed in claim 1, wherein said second element comprises a second safety lip disposed perimetrally thereto, to be broken when said second element pierces said chamber.

7. A cap as claimed in claim 1, wherein a second lip is disposed between said second element and an abutment provided on said first element.

8. A cap as claimed in claim 1, wherein said thread extends through a height such that, when the first element is in an upper limit stop position, the tooth is engaged in the thread, whereas when the first element is in a lower limit stop position, the tooth is disengaged from said thread, such that counter-rotating the first element does not cause separation of the first and second element.

* * * * *